United States Patent [19]

Schachtner

[11] Patent Number: 4,579,765

[45] Date of Patent: Apr. 1, 1986

[54] PROCESS FOR IMPROVING THE END-USE PROPERTIES OF TUFTED FLOOR COVERINGS

[75] Inventor: Gert Schachtner, Frankfurt am Main, Fed. Rep. of Germany

[73] Assignee: Hoechst Aktiengesellschaft, Fed. Rep. of Germany

[21] Appl. No.: 744,409

[22] Filed: Jun. 13, 1985

[30] Foreign Application Priority Data

Jun. 15, 1984 [DE] Fed. Rep. of Germany ..... 3422289

[51] Int. Cl.[4] ..... B32B 3/02; B32B 33/00

[52] U.S. Cl. ..... 428/95; 428/96; 428/97

[58] Field of Search ..... 428/95, 96, 97

[56] References Cited

U.S. PATENT DOCUMENTS 4,401,704 8/1983 Zegota ..... 428/96

4,439,474 3/1984 Sagel ..... 428/96

*Primary Examiner*—Marion C. McCamish

*Attorney, Agent, or Firm*—Connolly and Hutz

[57] ABSTRACT

A process for improving the end-use properties of tufted floor coverings, which comprises, in the manufacture of tufted floor coverings, mixing the dispersions or latexes which are necessary for the precoat and/or for the second coat, before their compounding, with a fluorosurfactant of the formula $$Rf—C_2H_4O—R$$

where Rf denotes a radical of the formula $C_6F_{13}$, $C_8F_{17}$, $C_{10}F_{21}$ or $C_{12}F_{25}$, R denotes a group of the formulae $$—(C_2H_4O)_n—H,\ —SO_3M \text{ or } —COCH_2\underset{\underset{SO_3M'}{|}}{CH}—COOCH_2CH—Rf,$$

M and M′ denote sodium, potassium or $NH_4$ and n denotes a number from 4 to 8.

The fluorosurfactant increases the tuft anchorage of the pile yarns and the adhesion of the backing.

1 Claim, No Drawings

PROCESS FOR IMPROVING THE END-USE PROPERTIES OF TUFTED FLOOR COVERINGS

The pile yarns are bound into the base fabric of tufted floor coverings by means of a so-called precoat with natural latex or synthetic latex, for example based on 40:60 or 60:40 butadiene-styrene, with dispersions of plastics, for example on the basis of polyvinyl acetate, or with mixtures of polyvinyl acetate dispersions and synthetic or natural latex or with polyurethane.

Preference is given to butadiene-styrene latex (about 50%), for example in the ratio of 40:60, 60:40 or 35:60+3.5 acrylic acid and polyvinyl acetate dispersions (50% strength), copolymers of vinyl acetate with dibutyl maleate, for example in the ratio 77/23 (about 50% strength), copolymers of styrene/butyl acrylate/acrylonitrile/methacrylic acid/acrylamide, for example in the ratio 16:61:25:2:1 or 25:53:25:2:1, copolymers of ethyl acrylate/acrylonitrile/n-methylacrylamide 6:3:1, copolymers of butyl acrylate/vinyl acetate/n-methylolacrylamide 35:55:10, and also graft polymers (partially hydrolized), such as 50% polyvinyl alcohol, 25% polyvinyl acetate and 25% polyethylene.

The precoat customarily also contains thickener and chalk or aluminum hydroxide as filler. This precoat is applied to the back of the carpet by face padding.

This precoat is generally covered with an additional back coating, either a foam coat or top coat, which serves as an adhesive base for a textile backing. This second coat is applied by doctor coating. However, the textile backing can also be stuck on in the course of the application of the precoat by passing the carpet, after it has been face-padded with the precoat, past a contact roll which presses the backing against the tacky, pigmented latex dispersion.

It has now been found that both the binding of the pile yarns into the precoat and the adhesive bonding of a textile backing can be significantly improved by adding fluorosurfactants to the precoat or to the second coat.

The invention accordingly provides a process for improving the end-use properties of tufted floor coverings, which comprises, in the manufacture of tufted floor coverings, mixing the dispersions or latexes which are necessary for the precoat and/or for the second coat, before their compounding, with a fluorosurfactant of the formula $$Rf—C_2H_4O—R$$

where Rf denotes a radical of the formula $C_6F_{13}$, $C_8F_{17}$, $C_{10}F_{21}$ or $C_{12}F_{25}$, R denotes a group of the formulae $$—(C_2H_4O)_n—H,\ —SO_3M \text{ or } —COCH_2\underset{\underset{SO_3M'}{|}}{CH}—COOCH_2CH_2—Rf,$$

M and M' denote sodium, potassium or $NH_4$ and n denotes a number from 4 to 8.

Preference is given to those fluorosurfactants which consist of a mixture of different individual compounds having the same meaning for R but different meanings for Rf. M denotes in particular $NH_4$ and M' denotes sodium, M and M' being present as cations and the corresponding sulfo radicals as anions. It is essential for the invention that the fluorosurfactant is at first mixed separately with the latex or the dispersion before this mixture is then used, through addition of the other components, to prepare the precoat or second coat material. The fluorosurfactant is added to the latex or the dispersion for the precoat in an amount of 0.1 to 0.2% by weight. If a textile backing is laminated on at the same time, the amount of fluorosurfactant in the latex or in the dispersion for the precoat is 0.1 to 0.5% by weight. If this textile backing is bonded to the base fabric by means of a second coat, the latex or the dispersion for this second coat contains 0.1 to 0.3% by weight of fluorosurfactant.

The detailed composition of precoat and second coat corresponds to the state of the art in this field, so that there is no need to discuss the nature and amount of the various components in detail, since they are sufficiently well known to the person skilled in the art. Typical recipes for the precoat contain for example 100 parts of styrene-butadiene latex or natural latex, 200–400 parts of chalk, 0.3 part of water softener and 2 parts of thickener based on acrylates or cellulose derivatives. The second coat can comprise for example 100 parts of styrene-butadiene latex (plasticized) or natural latex and 150 parts of chalk or aluminum hydroxide. An additional component is then the fluorosurfactant, as specified above. The fluorosurfactant can be introduced either in the precoat or in the second coat, but it is also possible to mix this fluorosurfactant into the latex or dispersion for both coating compositions.

The addition of the fluorosurfactants to the latex or dispersion with subsequent compounding has the effect of increasing the tuft anchorage of the pile yarns, even those made of hydrophobic material, as a consequence of improved penetration and adhesion. If a textile backing is bonded on, the addition of the fluorosurfactants has the effect of markedly increasing the adhesive strength of the backing. Simultaneous effects are the reduced fraying of the floor covering on cutting and the improved anchorage of pile loops in the area of a cut.

EXAMPLES (Parts are by weight)

1. Adhesion of a textile polyacrylonitrile backing.

The application of a precoat compound by face padding was followed by the application of an adhesive coat of the following composition:

100 parts of styrene/butadiene latex 50:50 (plasticized)
150 parts of aluminum hydroxide
5 parts of water
0.125 part of the compound of the formula $$Rf—C_2H_4O—SO_3NH_4$$

Rf=42% $C_6F_{13}$; 31% $C_8F_{17}$; 15% $C_{10}F_{21}$; remainder $C_{12}F_{25}$ foamed
weight per liter 600 g
wet addon 600 g/m$^2$
adhesive strength: 3.14 dan in newtons
width of strip 25 mm
tear length 100 mm If the procedure is repeated without the addition of the fluorosurfactant, the adhesive strength is only 1.96 dan.

2. Application of a precoat compound by means of face padding followed by adhesion of a textile polypropylene ribbon backing:

200 parts of styrene/butadiene latex 50:50
0.1 part of fluorosurfactant of Example 1
175 parts of chalk 15 parts of thickener 2.5% strength
1.2 parts of zinc oxide activated 50% strength foamed weight per liter 600 g
wet addon 600 g/m$^2$
adhesive strength: 0.6677 dan of the backing If 0.2 part of the same fluorosurfactant is used the adhesive strength obtained for the backing is 0.82 dan. Without fluorosurfactant, however, and otherwise identical conditions, the adhesive strength is only 0.497 dan.

3. Tuft anchorage of a tufted carpet floor covering which has a hydrophobic pile (fluorinated PA fibers) with simultaneous adhesion of a jute backing:
styrene/butadiene latex 60:40: 1776 kg
fluorosurfactant of Example 1: 1.8 kg
hexametaphosphate 3 kg
chalk 3000 kg
acrylate thickener 20 kg
application: face padding with subsequent application of the backing
beige: tuft anchorage of the pile: 2.58 kp+38.7%
grade: adhesive strength of backing: 102 dan; improvement by 46.2%.
green tuft anchorage of the pile: 2.49 kp+33.9% grade adhesive strength of backing: 102 dan improvement by 46.2%.

If the procedure is repeated without fluorosurfactant, the tuft anchorage is only 1.86 kp and the adhesive strength only 0.6977 dan.

I claim:

1. A process for improving the end-use properties of tufted floor coverings, with comprises, in the manufacture of tufted floor coverings, mixing the dispersions or latexes which are necessary for the precoat and/or for the second coat, before their compound, with a fluorosurfactant of the formula $$Rf—C_2H_4O—R$$

where Rf denotes a radical of the formula $C_6F_{13}$, $C_8F_{17}$, $C_{10}F_{21}$ or $C_{12}F_{25}$, R denotes a group of the formulae $$—(C_2H_4O)_n—H,\ —SO_3M \text{ or } —COCH_2\underset{\underset{SO_3M'}{|}}{CH}—COOCH_2CH_2—Rf,$$

M and M′ denote sodium, potassium or $NH_4$ and n denotes a number from 4 to 8.

* * * * *